United States Patent [19]

Cannon

[11] 4,401,137

[45] Aug. 30, 1983

[54] FORMING FABRIC SEAM AND METHOD OF PRODUCING

[75] Inventor: Frederick W. Cannon, Green Point, Australia

[73] Assignee: Albany International Corp., Menands, N.Y.

[21] Appl. No.: 85,902

[22] Filed: Oct. 18, 1979

[30] Foreign Application Priority Data

Nov. 30, 1978 [AU] Australia ..... 42079/78

[51] Int. Cl.[3] ..... D03D 3/04

[52] U.S. Cl. ..... 139/383 A; 162/DIG. 1

[58] Field of Search ..... 139/383 AA, 383 A, 425 A; 74/231 J, 239; 162/DIG. 1, 341, 258

[56] References Cited

U.S. PATENT DOCUMENTS 4,026,331 5/1977 Lees et al. ..... 139/425 A
4,095,622 6/1978 MacBean ..... 139/383 A
4,182,381 1/1980 Gisbourne ..... 139/383 A

FOREIGN PATENT DOCUMENTS

WO79/00026 1/1979 PCT Int'l Appl. ..... 139/383 A
322980 6/1970 Sweden ..... 139/383 A

*Primary Examiner*—Henry Jaudon
*Attorney, Agent, or Firm*—Kane, Dalsimer, Kane

[57] ABSTRACT

A forming fabric for papermaking machines is produced by weaving a conventional fabric with warp yarns extending from each of two ends. A selected number of extended warps are cut with each having an adjacent extending warp. Loops are formed with the extending warps and the ends of extending warps are rewoven through provided fills to a position near the cut warps and leaving ends of the warps projecting from the surface of the fabric. The loops are interlaced and a join pin inserted. The projecting ends are pulled to collapse the loops about the join pin.

15 Claims, 8 Drawing Figures

FORMING FABRIC SEAM AND METHOD OF PRODUCING

BACKGROUND OF THE INVENTION

Forming fabrics used on papermaking machinery are of a great variety, examples of which are single layer and double layer fabrics. In use these fabrics are mounted on the machine in the form of a conveyor or endless belt. When the forming fabric is produced as a flat fabric it must be made endless and into a belt by joining the ends. Many methods are used to seam including the utilization of sewn in loops. It has been generally accepted in the art that for a particular seam to be useful it must not be greater in thickness than the main body of the fabric and the permeability to liquid of the fabric and seam must be substantially the same, otherwise undesirable marking of the paper being formed can occur. These criteria are especially difficult to satisfy in single layer fabrics.

Presently there are a number of papermaking machines and specifically inverform machines where forming fabrics can only be installed by a time consuming hand weaving process. On non-cantilevered inverform machines where the forming fabric must be supplied as an open ended, flat cloth and joined or rewoven into an endless belt on the machine many man hours of work and extended periods of machine down time are required. The standard method utilized for many years for installation of bronze wire forming media was to braze two edges after preparation. This method cannot be used for plastic forming fabrics which must be spliced together by a hand weaving process to form the endless belt. Glues, adhesives and/or welding of the seam area is not satisfactory due to marking of the paper sheet. Non-marking pin seams have been available for two layer woven fabrics but satisfactory pin seams have not been available for single layer fabrics.

All presently used methods of joining plastic fabrics, both single layer and multilayer, into endless belts, apart from hand woven splices, are either mechanically weak or impart an objectionable mark to the paper sheet. The hand woven splice method is excessively time consuming on these high cost production machines.

SUMMARY OF THE INVENTION

Using the warp yarn system and a hand weaving device, loops are formed at each of two ends of a measured length of forming fabric. Loops may be formed from each pair of warp threads across the fabric width, or from each second pair as may be desired. These loops are formed around a forming pin of sufficient size to allow easy lacing. A typical and suitable size pin would be 1.2 mm diameter. Loops are formed and/or treated after formation in such a fashion that the plane of the loop is at right angles to the plane of the forming fabric. This treatment may be for example heat treatment, or chemical treatment. During the process of loop formation fill yarns are removed from the end of the fabric; warp yarns, adjacent to the intended loop warp are severed close to the remaining woven fabric; fill yarns are interwoven from the end of the woven fabric to a position in the vicinity of the forming pin; extending warp yarns are looped around the forming pin and woven back through the fills to a position near the severed warps where tails of the loop warp are left projecting from the surface of the fabric for later use.

An alternate method would be to sever the adjacent warp yarns before removing the fills.

When installation on the papermaking machine is required, the previously formed loops on either end of the fabric are interlaced and a suitable joining pin inserted through the interlaced loops to form an endless belt. This pin may be equal to or less than the shute diameter in the woven fabric and may be metal, such as stainless steel, or may be plastic monofilament. Due to the relatively large size of the loops the pin is easily inserted across the full width of the fabric. However, these large loops would cause different drainage and retention characteristics in the area of the pin seam, creating an objectionable mark in the sheet of paper. The "tails" previously left untrimmed during loop formation are pulled causing the loops to collapse around the previously inserted joining pin and making the pin seam area essentially the same as the body of the cloth. These tails are then trimmed off level with the surface of the forming fabric to form a flat, uniform surface. This assembled non-marking pin seam may then be treated by chemical, ultrasonic or microwave radiation in the area adjacent to the pin, to increase the strength of the seam and ensure binding of the warp threads, which may have been disturbed by the process of loop formation and seam assembly.

DESCRIPTION OF THE PREFERRED EMBODIMENTS

Figure 1:
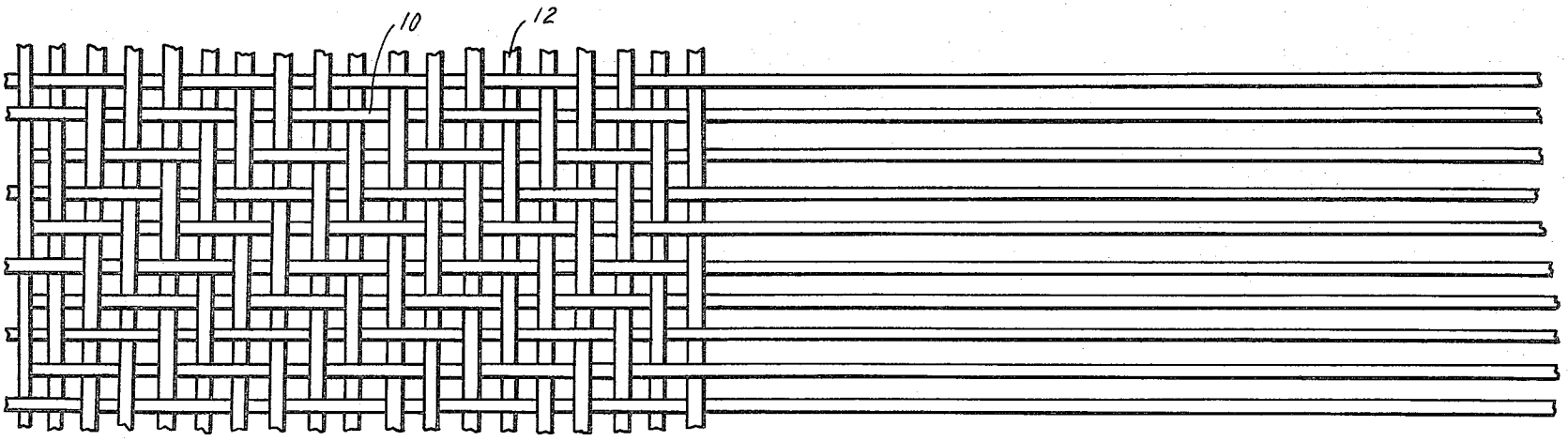
FIGS. 1, 2 and 3 are enlarged segmentary top plan views of one end of a forming fabric diagramatically showing intermediate steps in the practice of this invention.
Figure 2:
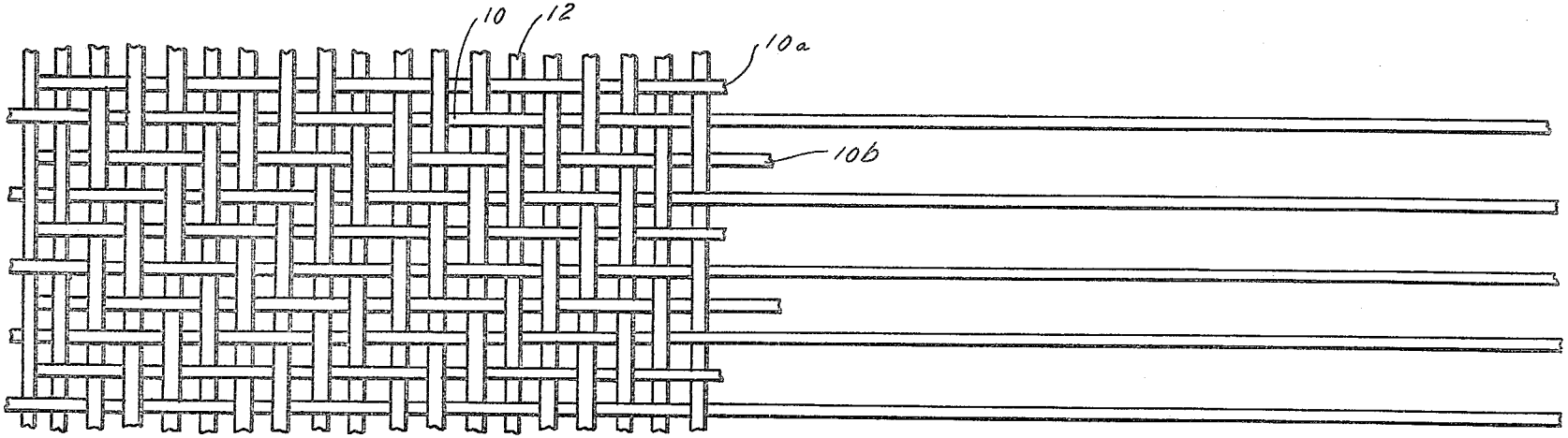
Figure 3:
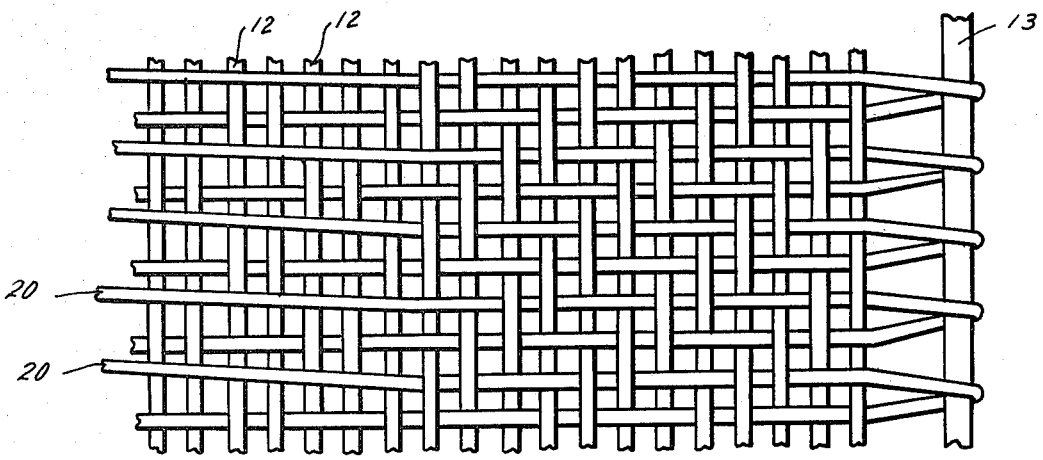
Figure 4:
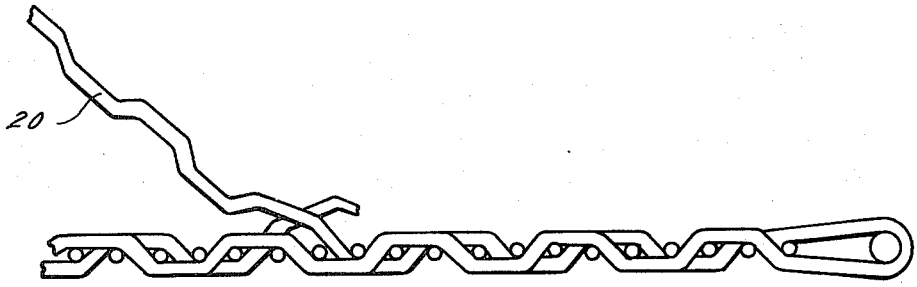
FIG. 4 is a section taken parallel to the warp on the forming fabric shown in FIG. 3.
Figure 5:
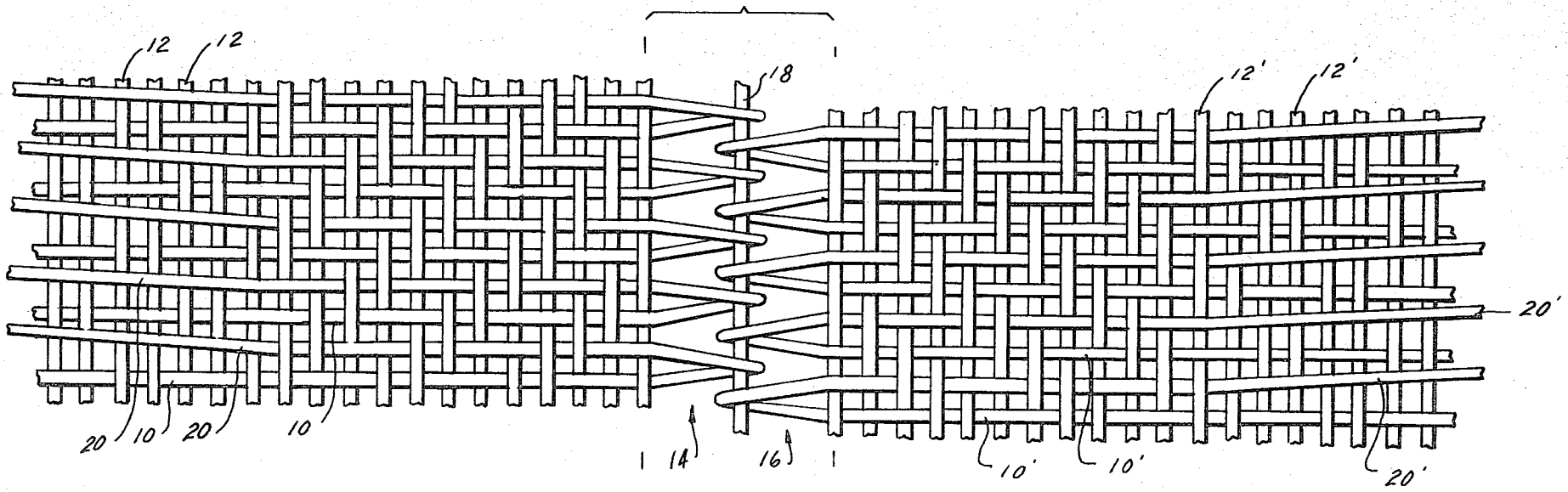
FIG. 5 is a segmentary top plan view of the two ends of the fabric joined in a further step in the practice of this invention and prior to pulling of the join tails to collapse the loops about the join pin.
Figure 6:
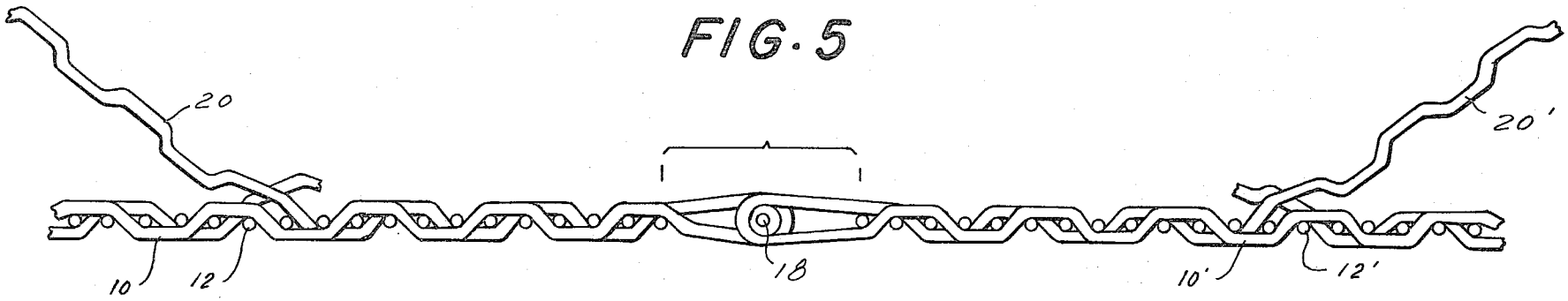
FIG. 6 is a section taken parallel to the warp on the forming fabric shown in FIG. 5.

One end of a forming fabric of single layer weave is shown in FIGS. 1, 2, 3 and 4, it being understood that the remaining end of the fabric is treated in a similar manner in the practice of the invention. The warp yarns are indicated by the numeral 10 and the weft yarns are indicated by the numeral 12. From a conventional woven fabric the filling yarns in zone X are ravelled out. Alternative warps 10*a* and 10*b* are stagger cut as shown and the ends discarded leaving the remaining warp yarn 10 extending from the fabric end. Some of the fills are replaced and interwoven with the extending warps. In the vicinity of the last replaced fill yarn 12*a* the extending warps 10 are looped and woven back through the replaced fills taking the place of cut warps 10 and 10*b* leaving tails 20 extending from the fabric surface. A hand weaving device as is well known in the industry may be employed for this purpose. Loops may be formed from each alternate warp yarn across the fabric width, or in other arrangements as desired. It is important that the loops are formed of sufficiently large diameter to readily and easily receive the tie pin shown in FIGS. 5–8 and to allow easy lacing. The loops generally will be formed three of four times larger than required. The loops can be formed around a forming pin 13. In FIGS. 5–8 the end of the fabric shown on the left is identified as the "A"0 body and the end on the right as the "B" body. The join tails on A body are indicated by the numeral 20 and the join tails on B body by the numeral 20'. The join tails are allowed initially to project from the surface of the fabric for later use. Similarly the warp and fill on the "B" body are respectively identified as 10' and 12'.

The seam at this point is finished with the exception of the join tails. The loops 14 on the A body and 16 on the B body are formed and/or treated after formation in such a fashion that the plane of the loop is at right angles to the plane of the forming fabric. This treatment may be for example heat treatment, or chemical treatment, as is known in the industry.

Figure 7:
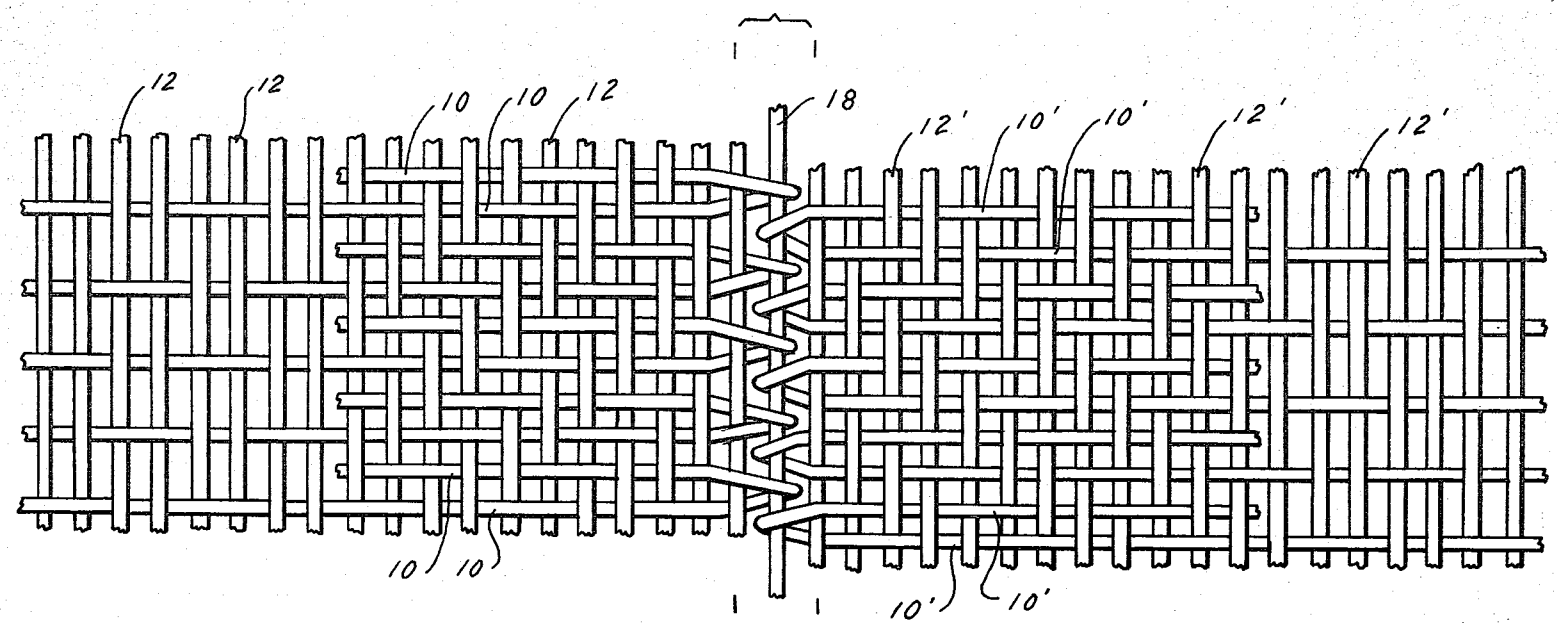
FIG. 7 is a segmentary top plan view of the forming fabric of FIG. 5 after pulling of the join tails to collapse the loops about the join pins and prior to trimming the projecting join tails.
Figure 8:
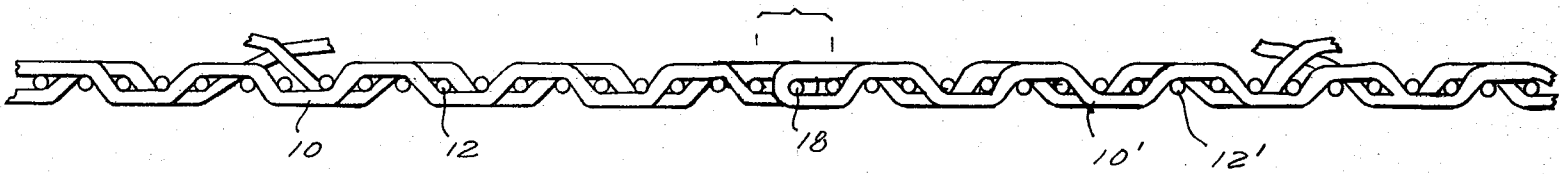
FIG. 8 is a section cut similar to that of FIG. 6 but on the forming fabric as shown in DIG. 7.

When installation on the papermaking machine is desired the fabric is installed on the machine and loops 14 and 16 are interlaced and join pin 18 inserted. This pin may be equal to or less than the shute diameter in the woven fabric and may be of any suitable material such as stainless steel, plastic monofilament or other. At this point there is a great deal of open space at the drain area and the presence of the large loops would cause different drainage and retention characteristics in the area of the seam. To reduce this open space and closely approximate the surface and mesh of the entire fabric the join tails 20 and 20' are pulled. By pulling on the join tails the crimp in the join is relocated and the size of the pin seam loops 14 and 16 are reduced. This draws the A and B bodies closer together at the area of the join with the loops collapsing around the join pins and making the seam area essentially the same as the body of the fabric as is shown in FIGS. 7 and 8.

This non-marking pin seam may now be treated by chemical, ultrasonic or microwave radiation in the area adjacent the pin to increase the strength of the seam and ensure binding of the warp threads.

The seam has particular application in single layer forming fabrics but is also useful in double layer, multilayer and course mesh double layer forming fabrics and is not limited to the weave shown.

I claim:

1. The method of producing a forming fabric for use in a papermaking machine which includes the steps of weaving a fabric having a warp and a weft system, forming loops at each of two ends of the fabric by extending selected warp yarns, and providing a tail portion of each loop forming warp projecting from the surface of the fabric whereby said loops may be interlaced with a joining pin through said loops to form an endless belt and said tail portions pulled causing the loops to collapse around the joining pin.

2. The method of producing a forming fabric for use in a papermaking machine which includes the steps of weaving a fabric having a warp and a weft system, forming loops at each of two ends of the fabric by extending selected warp yarns, providing a tail portion of each loop forming warp extending from the surface of the fabric, interlacing said loops, inserting a joining pin through the interlaced loops to form an endless belt, and pulling said tail portions to cause the loops to collapse around the joining pin.

3. The method of producing a forming fabric in accordance with claim 2 in which after collapse of the loops the tail portions are trimmed off.

4. The method of producing a forming fabric in accordance with claim 3 in which after formation the belt is treated in the area adjacent the pin to increase the strength of the seam and ensure binding of the warp threads.

5. The method of producing a forming fabric in accordance with claim 3 in which after formation the belt is chemically treated in the area adjacent the pin to increase the strength of the seam and ensure binding of the warp threads.

6. The method of producing a forming fabric in accordance with claim 3 in which after formation the belt is ultrasonically treated in the area adjacent the pin to increase the strength of the seam and ensure binding of the warp threads.

7. The method of producing a forming fabric in accordance with claim 3 in which after formation the belt is treated by microwave radiation in the area adjacent the pin to increase the strength of the seam and ensure binding of the warp threads.

8. The method of producing a fabric which includes the steps of forming loops by extending threads of the fabric at two ends thereof and providing a tail portion of each of the threads so extended with the tail portion projecting from the surface of the fabric whereby said loops may be interlaced with a joining pin through said loops to form an endless belt and said tailportions pulled causing the loops to collapse around the joining pin.

9. The method of producing a fabric which includes the steps of forming loops by extending threads of the fabric at two ends thereof, providing a tail portion of each of the threads so extended projecting from the surface of the fabric, interlacing the loops, inserting a joining pin through the interlaced loops to form an endless belt and pulling the tail portions to cause the loops to collapse around the forming pin.

10. the method of producing a forming fabric for use in a papermaking machine comprising the formation of loops of sufficient size to be easily laced together on each end of a fabric, interlocking the loops and inserting a joining pin and reducing the diameters of the loops to form a seam area.

11. The method of producing a forming fabric in accordance with claim 10 in which the loops are formed of threads of the fabric and an end of the thread of each group is allowed to project from the fabric prior to joining and the diameter of each of said loops is reduced by pulling each respective projecting end.

12. The method of producing a fabric to be used as a forming fabric in a papermaking machine which includes the steps of forming loops by extending threads of the fabric at two ends thereof and providing a tail portion of each of the threads so extended with the tail portion projecting from the surface of the fabric and treating said loops to provide the planes thereof at right angles to the fabric.

13. The method of producing a fabric in accordance with claim 12 in which after treating said loops are interlaced, a join pin is inserted through said interlaced loops to form an endless belt, the tail portions are pulled causing the loops to collapse around the join pin and reduce the open area around the pin and a further treatment is provided to increase the strength of the seam and ensure the binding of the warp threads in the vicinity thereof.

14. The method of producing a fabric in accordance with claim 10 in which during the process of loop formation fill yarns are removed from the end of the fabric; warp yarns adjacent to the intended loop warp are severed close to the remaining woven fabric; fill yarns are interwoven from the end of the woven fabric to a position in the vicinity of the forming pin; extending warp yarns are looped around the forming pin and woven back through the fills to a position near the severed warps where tails of the loop warp are left projecting from the surface of the fabric.

15. The method of producing a fabric in accordance with claim 14 in which the adjacent warp yarns are severed before removing the fills.

* * * * *